US006010377A

United States Patent [19]

Dechelette et al.

[11] Patent Number: 6,010,377

[45] Date of Patent: Jan. 4, 2000

[54] HIGH CONTACT FORCE PIN-RECEIVING ELECTRICAL TERMINAL

[75] Inventors: Helen Dechelette, Paris; Patrick Dechelette, Le Plessis Robinson; Jerome Tamsson, Paris, all of France

[73] Assignee: Molex Incorporated, Lisle, Ill.

[21] Appl. No.: 08/801,395

[22] Filed: Feb. 20, 1997

[30] Foreign Application Priority Data

Mar. 11, 1996 [EP] European Pat. Off. ..... 96103785

[51] Int. Cl.[7] ..... H01R 13/187

[52] U.S. Cl. ..... 439/851; 439/852

[58] Field of Search ..... 439/851, 852, 439/843, 845, 381, 848

[56] References Cited

U.S. PATENT DOCUMENTS

| | | | |
|---|---|---|---|
| 3,963,302 | 6/1976 | Gourley | 439/852 X |
| 4,907,990 | 3/1990 | Bertho et al. | 439/851 |
| 5,188,545 | 2/1993 | Hass et al. | 439/851 |
| 5,288,250 | 2/1994 | Sumida | 439/701 |
| 5,288,251 | 2/1994 | Sumida | 439/701 |
| 5,419,723 | 5/1995 | Villiers et al. | 439/843 |
| 5,645,458 | 7/1997 | Hotea | 439/852 OR |
| 5,685,746 | 11/1997 | Maejima | 439/845 OR |

*Primary Examiner*—Paula Bradley
*Assistant Examiner*—Daniel Wittels
*Attorney, Agent, or Firm*—A. A. Tirva

[57] ABSTRACT

A high contact force pin-receiving electrical terminal includes a channel-shaped base joined to a forward pin engaging structure with a generally box-shaped pin receiving region. The pin engaging structure has a pair of spaced apart beams extending forwardly of the base to generally define opposed sides of the box-shaped region with opposed pin contacting surfaces for slidably engaging an inserted pin terminal. A resilient beam support member extends between and mechanically interconnects the forward, free ends of the beams to generally define a third side of the box-shaped region. A shroud extends forwardly of the base about at least portions of the beams to protect the beams during handling.

17 Claims, 5 Drawing Sheets

HIGH CONTACT FORCE PIN-RECEIVING ELECTRICAL TERMINAL

FIELD OF THE INVENTION

This invention generally relates to the art of electrical connectors and, particularly, to a high contact force electrical terminal for connecting a pin terminal with another circuit means.

BACKGROUND OF THE INVENTION

Electrically mateable connectors including mateable pin and receptacle contact terminals are widely used in a variety of forms throughout the electronics industry for electrically connecting two or more circuit members to each other. Contemporary industry specifications increasingly demand compact, more miniaturized connectors having higher circuit densities. This results in an ever-increasing miniaturization of the electrical contacts or terminals mounted in the connectors. Such miniaturization creates severe problems in providing high contact forces between the mating terminals, such as between mateable pin and receptacle contact terminals.

In order to solve these problems, a high contact force, high elastic response range pin-receiving electrical terminal was developed as shown in U.S. Pat. No. 4,907,999, dated Mar. 13, 1990 and assigned to the assignee of the present invention. The terminal of that patent provides high normal contact forces with thin metal stock materials. That type of terminal construction has proven to be very effective and very reliable.

However, recent industry specifications require mechanical performances which must be maintained despite severe environmental handling conditions. For example, terminals must be protected against deformation during handling, they must remain as smooth as possible when handled by an operator and they must be easily inserted and locked within a connector housing. The terminals must maintain a high contact force to avoid plating the terminals with noble metal materials. Furthermore, the locking features of the terminals must not be deformed during handling.

The present invention is directed to solving these myriad of problems by providing a high contact force electrical terminal of the type shown in the aforementioned U.S. Pat. No. 4,907,999 but with further improvements to protect and rigidify the terminal as well as facilitating locking of the terminal within a connector housing.

SUMMARY OF THE INVENTION

An object, therefore, of the invention is to provide a high contact force pin-receiving electrical terminal of the character described above.

In the exemplary embodiment of the invention, the terminal includes a channel-shaped base joined to a forward pin engaging structure with a generally box-shaped pin-receiving region. The pin engaging structure includes a pair of spaced apart beams extending forwardly of the base to generally define opposed sides of the box-shaped region, with opposed pin contacting surfaces for slidably engaging an inserted pin terminal. A resilient beam support member extends between and mechanically interconnects the forward, free ends of the beams to generally define a third side of the box-shaped region. The invention contemplates the improvement of a shroud extending forwardly of the base about at least portions of the beams to protect the beams during handling.

The shroud includes a portion defining a fourth side of the box-shaped region. The shroud further includes a four-sided distal end defining a passage through which the pin terminal is insertable into sliding engagement with the opposed pin contacting surfaces of the beams. Latch means are provided on the distal end to facilitate locking the terminal in an appropriate housing.

In the preferred embodiment, the beam support member comprises a U-shaped spring including spring arms extending from forward ends of the beams to join an interconnecting bight portion. Another feature of the invention includes a supporting web interconnecting the bight portion with the base. Lastly, a reinforcing rib is formed on the base in alignment with the supporting web.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
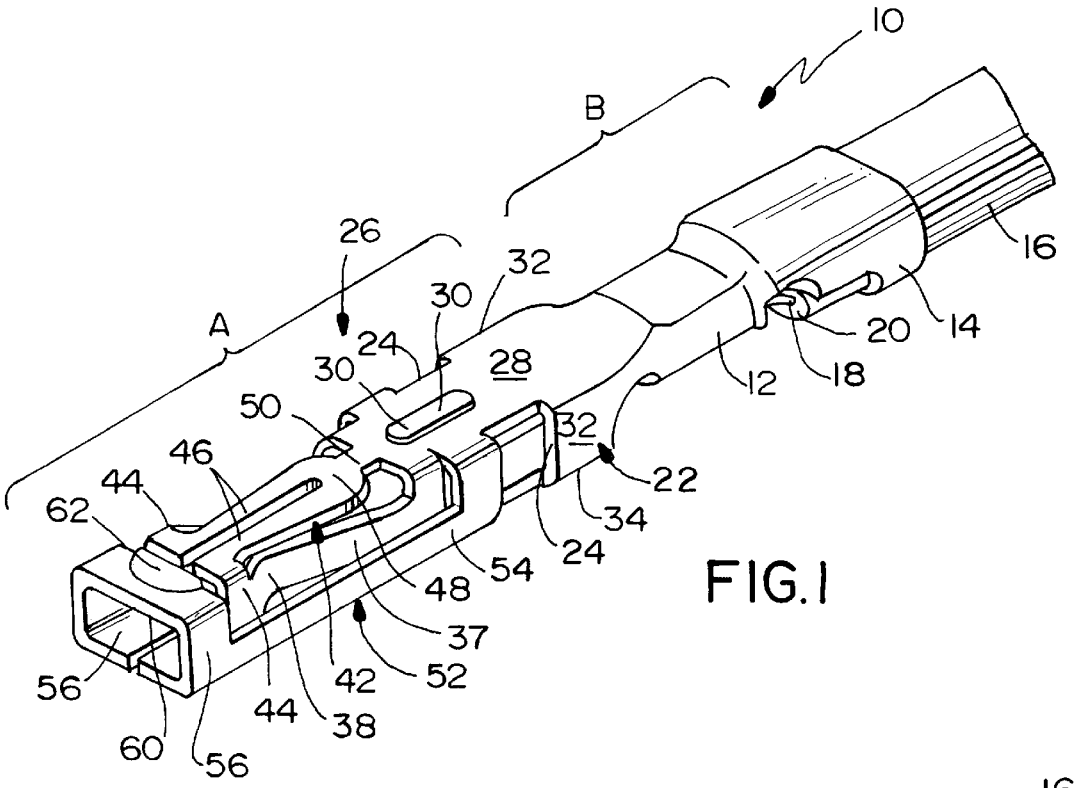
FIG. 1 is a perspective view of one side of an electrical terminal according to the invention.
Figure 2:
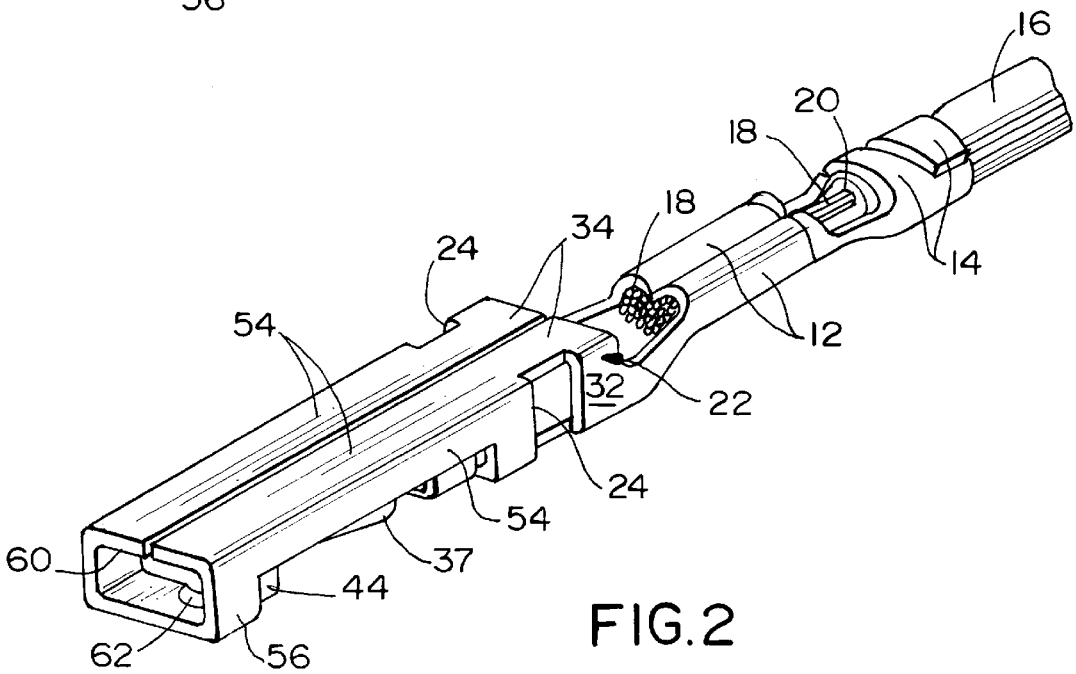
FIG. 2 is a perspective view of the opposite side of the terminal.
Figure 5:
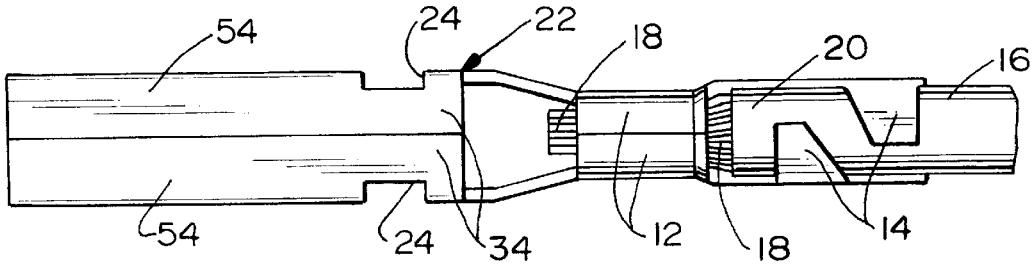
FIG. 5 is a bottom plan view of the terminal.
Figure 4:
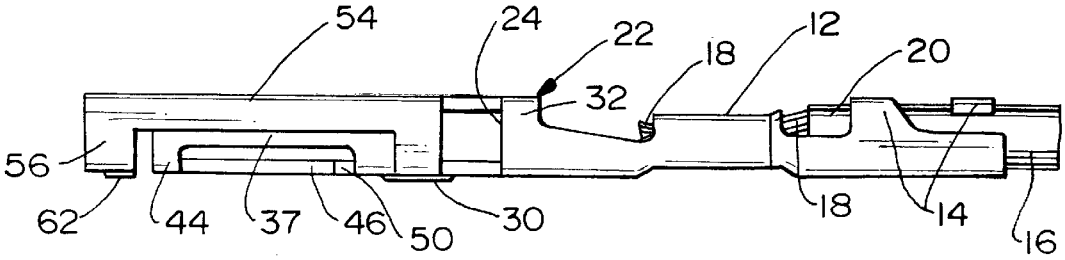
FIG. 4 is a side elevational view of the terminal.
Figure 3:
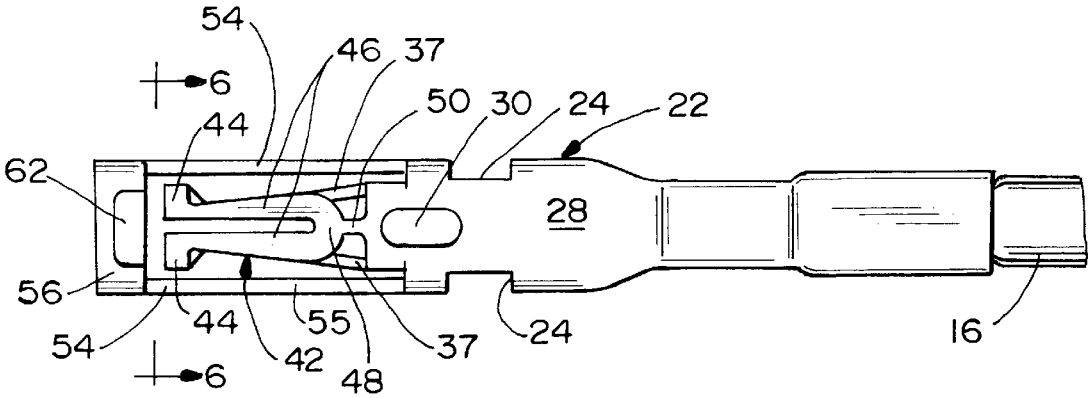
FIG. 3 is a top plan view of the terminal as viewed in FIG. 1.

Referring to the drawings in greater detail, and first to FIGS. 1–5, an integral, unitary metallic terminal is shown and generally designated 10. The terminal is stamped and formed from sheet metal stock to define an elongated electrical terminal including a front mating end "A" and a rear terminating end "B". The new and improved features of the invention are incorporated in front mating end "A", as described hereinafter. Rear terminating end "B" includes two pair of crimp arms 12 and 14 for terminating an electrical cable 16. The pair of crimp arms 12 are adapted for crimping onto and establishing electrical engagement with a conductor or conductors 18 of the cable, and rear crimp arms 14 are adapted to clamp onto the outer insulation or cladding 20 of the cable and provide strain relief therefore.

Front mating end "A" includes a generally channel or box-shaped base portion, generally designated 22, having side apertures 24. The base portion is integrally joined between rear terminating end "B" of the terminal and a forward pin engaging structure, generally designated 26. The base portion includes a flat or horizontal base wall 28 having a longitudinally extending reinforcing rib 30 formed therein, a pair of side walls 32 and a top wall structure 34. Apertures 24 are formed in side walls 22. The apertures are provided for interlocking the terminals within a module and are not relevant to the invention.

Forward pin engaging structure 26 defines a generally box-shaped pin receiving region. The pin engaging structure includes a pair of spaced apart contact beams 37 extending forwardly of base portion 22 to generally define opposed sides of the box-shaped pin receiving region. The beams are formed with inwardly bent contact sections 38 (FIG. 1) which define pin contact surfaces 40 (FIGS. 6 and 7) for slidably engaging an inserted pin terminal as described hereinafter.

A resilient beam support member, generally designated 42, extends between and mechanically interconnects the forward, free ends 44 of contact beams 37 to base portion 22 and generally defines a third side of the box-shaped pin receiving region. Beam support member 42 includes a U-shaped spring defining a pair of spring arms 46 extending from forward ends 44 of contact beams 37 to join an interconnecting bight portion 48. A supporting web 50 interconnects bight portion 48 with base wall 28 of base portion 22.

The invention contemplates the provision of a shroud, generally designated 52, extending forwardly of base portion 22 about at least portions of contact beams 37 to protect the beams during handling. More particularly, shroud 52 includes a pair of arms 54 extending forwardly from base portion 22 to a four-sided or box-shaped distal end 56. Actually, arms 54 are generally L-shaped in cross-section to protect two exposed sides of contact beams 37 as clearly seen in FIGS. 6 and 7. Arms 54 define a fourth side of the box-shaped pin receiving region as clearly seen in FIG. 2. Distal end 56 of shroud 52 defines a passage 60 through which the pin terminal is insertable into sliding engagement with the opposed pin contacting surfaces 40 of contact beams 37.

Lastly, distal end 56 of shroud 52 is formed with an outwardly projecting dimple or boss 62 (FIG. 1). As will be described hereinafter, boss 62 defines a latch on distal end 56 to facilitate locking the terminal in an appropriate connector housing.

Figure 6:
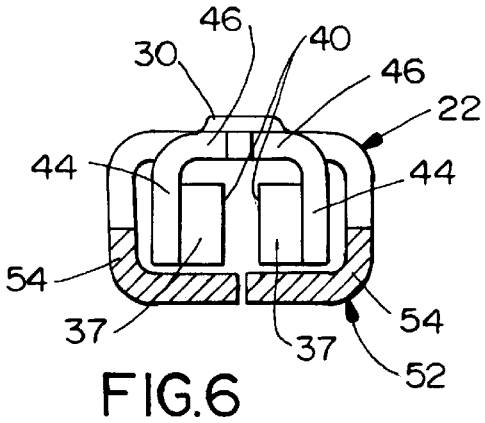
FIG. 6 is a vertical section taken generally along line 6—6 of FIG. 3.
Figure 7:
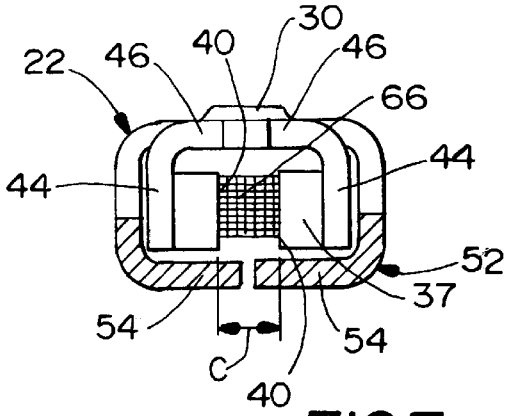
FIG. 7 is a vertical section similar to that of FIG. 6, but with a pin terminal inserted into the terminal.

FIGS. 6 and 7 show how contact beams 37 are deflected in response to insertion of a pin terminal therebetween. The spacing between pin contacting surfaces 40 is seen in FIG. 6 when the terminal is in its unstressed condition, i.e. without an inserted pin terminal. FIG. 7 shows contact surfaces 40 spread apart in the direction of double-headed arrow "C" in response to insertion of a male or pin terminal 66 between the contacting surfaces of contact beams 37. The beams, along with spring arms 46 of resilient beam support member 42 all spread apart and provide a very high contact force onto opposite sides of the terminal. As stated above, FIGS. 6 and 7 also clearly show how the L-shaped arms 54 of shroud 52 extend about three sides of the box-shaped pin receiving region to substantially protect contact beams 37.

Figure 8:
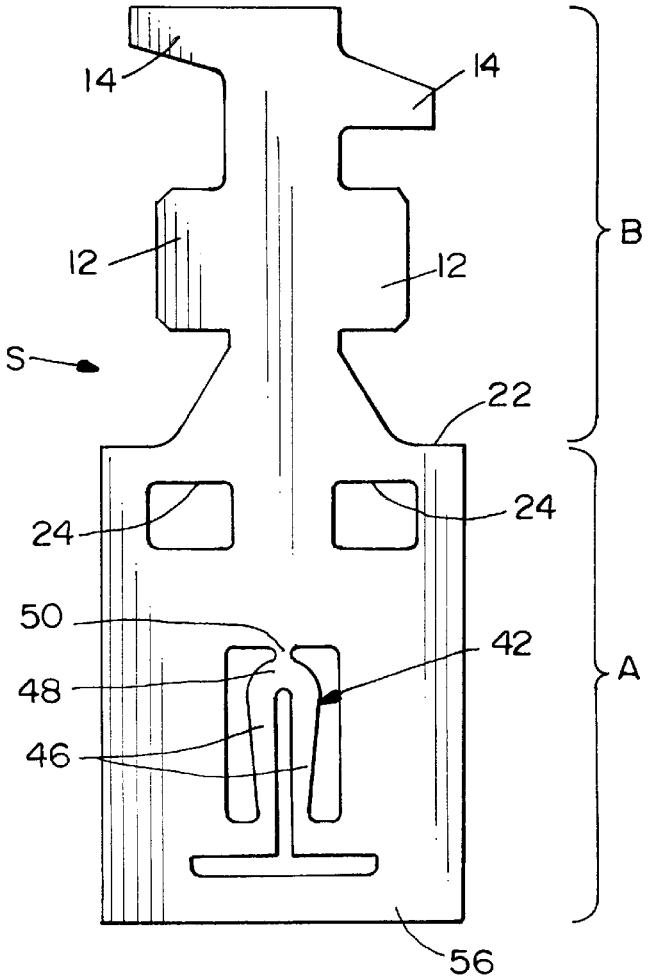
FIG. 8 is a stamped blank of sheet metal material from which the terminal is fabricated.

FIGS. 8–12 show a preferred method for fabricating the new and improved terminal 10 including forward mating end "A" and rear terminating end "B". Referring first to FIG. 8, a blank of sheet metal stock, generally designated "S", is stamped to include some of the components of the terminal, including crimp arms 12 and 14 and apertures 24 in base portion 22. Spring arms 46 and bight portion 48 of the U-shaped spring which forms the resilient beam support member 42 also are shown, along with web 50 which joins bight portion 48 with base portion 22.

It should be understood that, although a single blank of sheet metal stock "S" is shown in FIG. 8, a plurality of terminals can be progressively stamped and formed from a continuous strip of sheet metal material, with the terminals joined by a carrier assembly, as is disclosed in the aforementioned U.S. Pat. No. 4,907,990.

Figure 10:
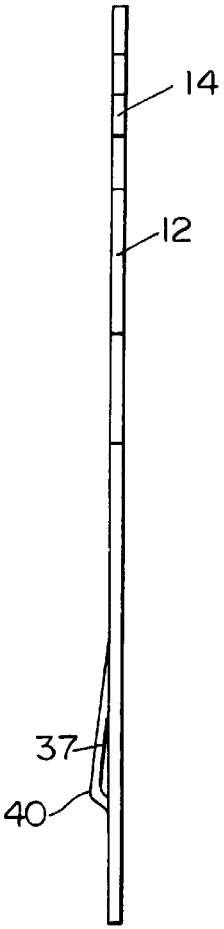
FIGS. 9 and 10 show the blank of FIG. 8 with the beams sheared and formed from the flat sheet metal material.
Figure 9:
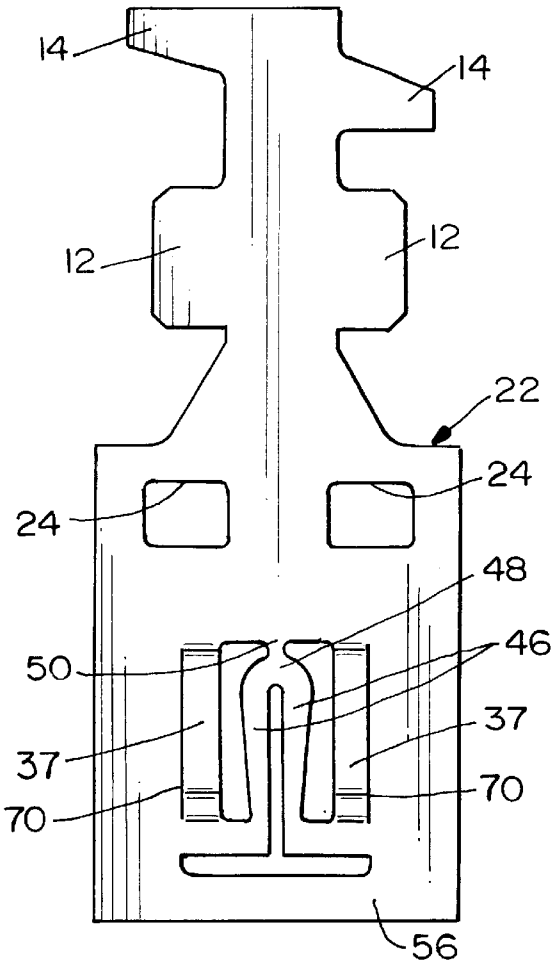

The next step in fabricating terminal 10 is shown in FIGS. 9 and 10 wherein contact beams 37 are sheared from the sheet metal stock, as at 70, and the contact beams are formed out of the plane of the sheet metal stock to define pin contacting surfaces 40 (FIG. 10).

Figure 12:
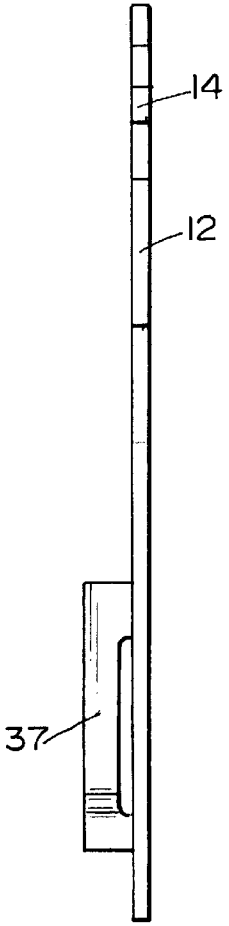
FIGS. 11 and 12 show the beams further sheared and turned upwardly of the flat sheet metal material.
Figure 11:
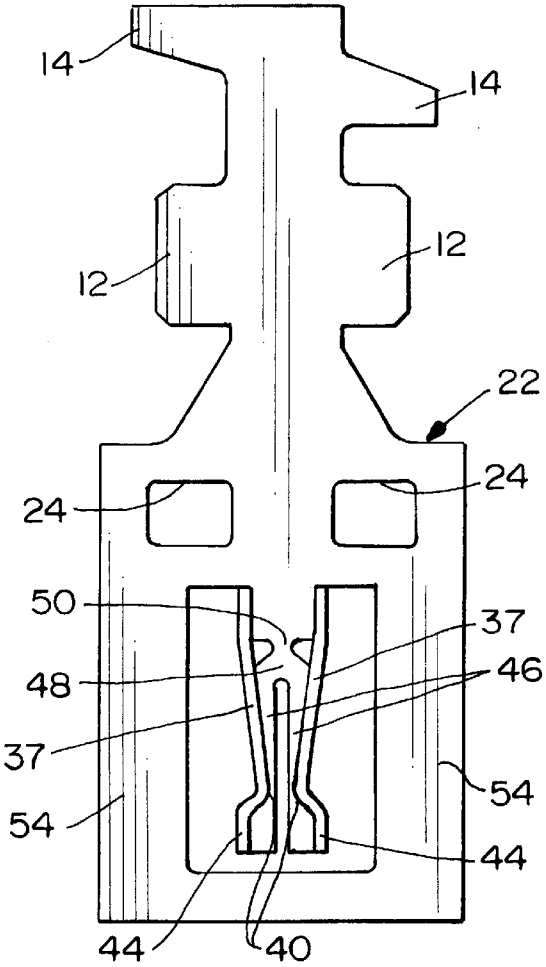

FIGS. 11 and 12 show the next step in fabricating terminal 10, wherein contact beams 37 are further sheared and formed upwardly out of the plane of the sheet metal stock such that the contact beams are in opposing juxtaposition and pin contacting surfaces 40 face each other in opposing directions.

The last step in fabricating terminal 10 is to form arms 54 of shroud 52 upwardly and out of the plane of the sheet metal stock in a manner to embrace contact beams 37. Simultaneously, crimp arms 12 and 14 might be at least partially formed upwardly out of the plane of the sheet metal stock, in preparation for terminating a cable 16. This final step can be understood by comparing FIGS. 11 and 12 with the final configuration of the terminal shown in FIGS. 1–7 and described above.

Figure 13:
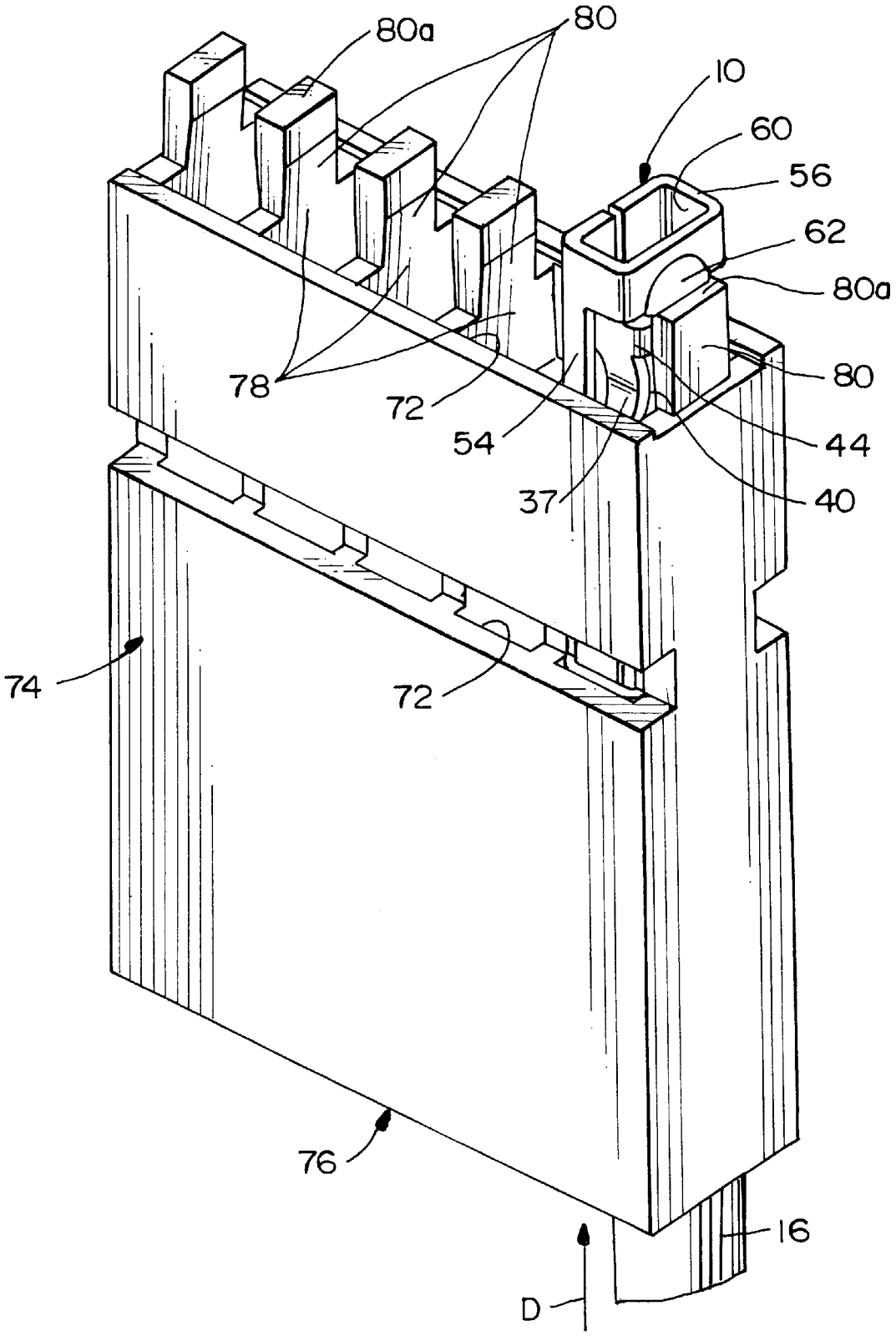
FIG. 13 shows one of the terminals inserted into a connector housing.

Lastly, FIG. 13 shows one of the terminals 10 according to the invention having been inserted into a passage 72 of an electrical connector housing, generally designated 74. The housing includes five passages 72, only one of which is shown as receiving a terminal 10. The terminals, along with their terminated electrical cables 16, are inserted into passages 72 from a rear end 76 of the housing in the direction of arrow "D". A plurality of partitions 78 separate passages 72, and the partitions have projections 80 extending forwardly of the housing. The projections define distal surfaces 80*a*, which are effective to snap beneath latch bosses 62 of the terminals for locking the terminals in position within their respective passages 72 of the housing.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A one piece high contact force pin-receiving electrical terminal which includes a channel-shaped base joined to a forward pin engaging structure with a genrally box-shaped pin receiving region, said pin engaging structure having a pair of spaced apart beams extending forwardly of the base to generally define opposed sides of the box-shaped region with opposed pin contacting surfaces for slidably engaging inserted pin for slidably engaging an inserted pin terminal, and a resilient beam support member extending between and mechanically interconnecting the forward, free ends of said beams to generally define a third side of said box-shaped region, the improvement comprising:

a shroud extending forwardly of the base about at least portions of the beams to protect the beams during handling.

2. A pin-receiving electrical terminal as in claim 1, wherein said shroud includes a portion defining a fourth side of said box-shaped region.

3. A pin-receiving electrical terminal as in claim 1, wherein said shroud includes a four-sided distal end defining a passage through which the pin terminal is insertable into sliding engagement with said opposed pin contacting surfaces.

4. A pin-receiving electrical terminal as in claim 3, including a latch means on said distal end to facilitate locking the terminal in an appropriate housing.

5. A pin-receiving electrical terminal as in claim 1, wherein said beam support member comprises a U-shaped spring including spring arms extending from forward ends of said beams to join an interconnecting bight portion, and including a supporting web interconnecting said bight portion with the base.

6. A pin-receiving electrical terminal as in claim 5, including a reinforcing rib on the base in alignment with said supporting web.

7. A pin-receiving electrical terminal as in claim 1, wherein said shroud includes a distal end located forwardly of said beams and defining a passage through which the pin terminal is insertable into sliding engagement with said opposed pin contacting surfaces of the beams.

8. A pin-receiving electrical terminal as in claim 1, including a latch means on said shroud to facilitate the terminal in an appropriate housing.

9. A pin-receiving electrical terminal as in claim 1, wherein said shroud includes a pair of arms extending from the base alongside said pair of beams.

10. A pin-receiving electrical terminal as in claim 9, wherein said arms are generally L-shaped in cross-section for substantially embracing said beams.

11. A one piece high contact force pin-receiving electrical terminal which includes a channel-shaped base joined to a forward pin engaging structure with a generally box-shaped pin receiving region, said pin engaging structure having a pair of spaced apart beams extending forwardly of the base to generally define opposed sides of the box-shaped region with opposed pin contacting surfaces for slidably engaging an inserted pin for slidably engaging an inserted pin terminal, and a resilient beam support member extending between and mechanically interconnecting the forward, free ends of said beams to generally define a third side of said box-shaped region, the improvement comprising:

a shroud extending forwardly of the base about at least portions of the beams to protect the beams during handling, the shroud including a portion defining a fourth side of said box-shaped region, and a distal end located forwardly of said beams and defining a passage through which the pin terminal is insertable into sliding engagement with said opposed pin contacting surfaces of the beams.

12. A pin-receiving electrical terminal as in claim 11, including a latch means on said distal end to facilitate locking the terminal in an appropriate housing.

13. A pin-receiving electrical terminal as in claim 11, wherein said beam support member comprises a U-shaped spring including spring arms extending from forward ends of said beams to join an interconnecting bight portion, and including a supporting web interconnecting said bight portion with the base.

14. A pin-receiving electrical terminal as in claim 13, including a reinforcing rib on the base in alignment with said supporting web.

15. A pin-receiving electrical terminal as in claim 11, including a latch means on said shroud to facilitate the terminal in an appropriate housing.

16. A pin-receiving electrical terminal as in claim 11 wherein said shroud includes a pair of arms extending from the base alongside said pair of beams.

17. A pin-receiving electrical terminal as in claim 16, wherein said arms are generally L-shaped in cross-section for substantially embracing said beams.

* * * * *